US008181271B2

(12) United States Patent
Sasaki et al.

(10) Patent No.: US 8,181,271 B2
(45) Date of Patent: May 22, 2012

(54) KNEEPAD WITH PROTECTIVE FLEXIBLE OUTER COVER

(75) Inventors: Jeffrey Sasaki, San Carlos, CA (US); Michael Dancyger, South Gate, CA (US)

(73) Assignee: Custom Leathercraft Manuf. Co., Inc., South Gate, CA (US)

( * ) Notice: Subject to any disclaimer, the term of this patent is extended or adjusted under 35 U.S.C. 154(b) by 282 days.

(21) Appl. No.: 11/985,725

(22) Filed: Nov. 16, 2007

(65) Prior Publication Data

US 2009/0126066 A1 May 21, 2009

(51) Int. Cl.
*A41D 13/00* (2006.01)

(52) U.S. Cl. ..... 2/24

(58) Field of Classification Search ..... 2/22–24, 2/16, 20, 19, 911, 455, DIG. 3; 602/23, 62
See application file for complete search history.

(56) References Cited

U.S. PATENT DOCUMENTS

| | | | | | |
|---|---|---|---|---|---|
| 3,242,499 | A * | 3/1966 | Giusto Fonda-Bonardi | .... | 2/2.13 |
| 4,068,312 | A * | 1/1978 | Ledesma | ..... | 2/24 |
| 4,250,578 | A * | 2/1981 | Barlow | ..... | 2/24 |
| 4,370,754 | A * | 2/1983 | Donzis | ..... | 2/463 |
| 5,031,240 | A * | 7/1991 | Nierhaus | ..... | 2/24 |
| 5,263,203 | A * | 11/1993 | Kraemer et al. | ..... | 2/413 |
| 5,383,843 | A * | 1/1995 | Watson et al. | ..... | 602/13 |
| 5,500,955 | A * | 3/1996 | Gongea | ..... | 2/24 |
| 5,537,689 | A * | 7/1996 | Dancyger | ..... | 2/24 |
| 6,105,164 | A * | 8/2000 | Huang | ..... | 2/22 |
| 6,131,196 | A * | 10/2000 | Vallion | ..... | 2/24 |
| 6,253,376 | B1 * | 7/2001 | Ritter | ..... | 2/24 |
| 6,623,835 | B2 * | 9/2003 | Chang | ..... | 428/138 |

* cited by examiner

*Primary Examiner* — Tejash Patel

(57) ABSTRACT

A kneepad includes a number of layered material portions and an inner padding portion located between the layered material portions. An integral protective covering is attached to an outer surface of the kneepad. A pair of attachment elements is adapted to attach the kneepad to a person's knee. The protective portion includes a number of raised elements that operate to form pneumatic cushioning.

20 Claims, 4 Drawing Sheets

KNEEPAD WITH PROTECTIVE FLEXIBLE OUTER COVER

BACKGROUND

1. Field

The embodiments relate to kneepads, and in particular to kneepads with a compressible outer protective cover 2. Description of the Related Art Protective knee pads are used by in many different fields for protection or to provide comfort to individuals. For example, knee pads are used when kneeling on hard or rough surfaces or to reduce blunt force trauma. Various knee pad constructions are available and typically comprise a rigid case or padding which is fitted over the knee and held in place by various attachment elements.

SUMMARY

One embodiment includes a kneepad with an outer surface, an inner padding portion disposed within the outer surface, a protective portion connected to a first side of the outer surface, and means for attaching. The protective portion includes a plurality of raised elements.

Another embodiment is a kneepad including a number of layered material portions, at least one inner padding portion connected between the number of layered material portions, an integral protective covering connected to an outer surface of the kneepad and a pair of attachment portions. The protective portion includes a number of raised elements that operate to form pneumatic cushioning.

Yet another embodiment includes a kneepad including a number of material portions, at least one inner padding portion attached between a first material portion and a second material portion, an integral protective covering connected to an outer surface of the kneepad and a pair of adjustable attachment portions. The protective portion includes a number of raised elements, each of the raised elements is independently pneumatically compressible.

BRIEF DESCRIPTION OF THE DRAWINGS

The embodiments are illustrated by way of example, and not by way of limitation, in the Figures of the accompanying drawings and in which like reference numerals refer to similar elements and in which.

DETAILED DESCRIPTION

The Embodiments discussed herein generally relate to protective kneepads. Referring to the Figures, exemplary embodiments will now be described. The exemplary embodiments are provided to illustrate the embodiments and should not be construed as limiting the scope of the embodiments.

Figure 1:
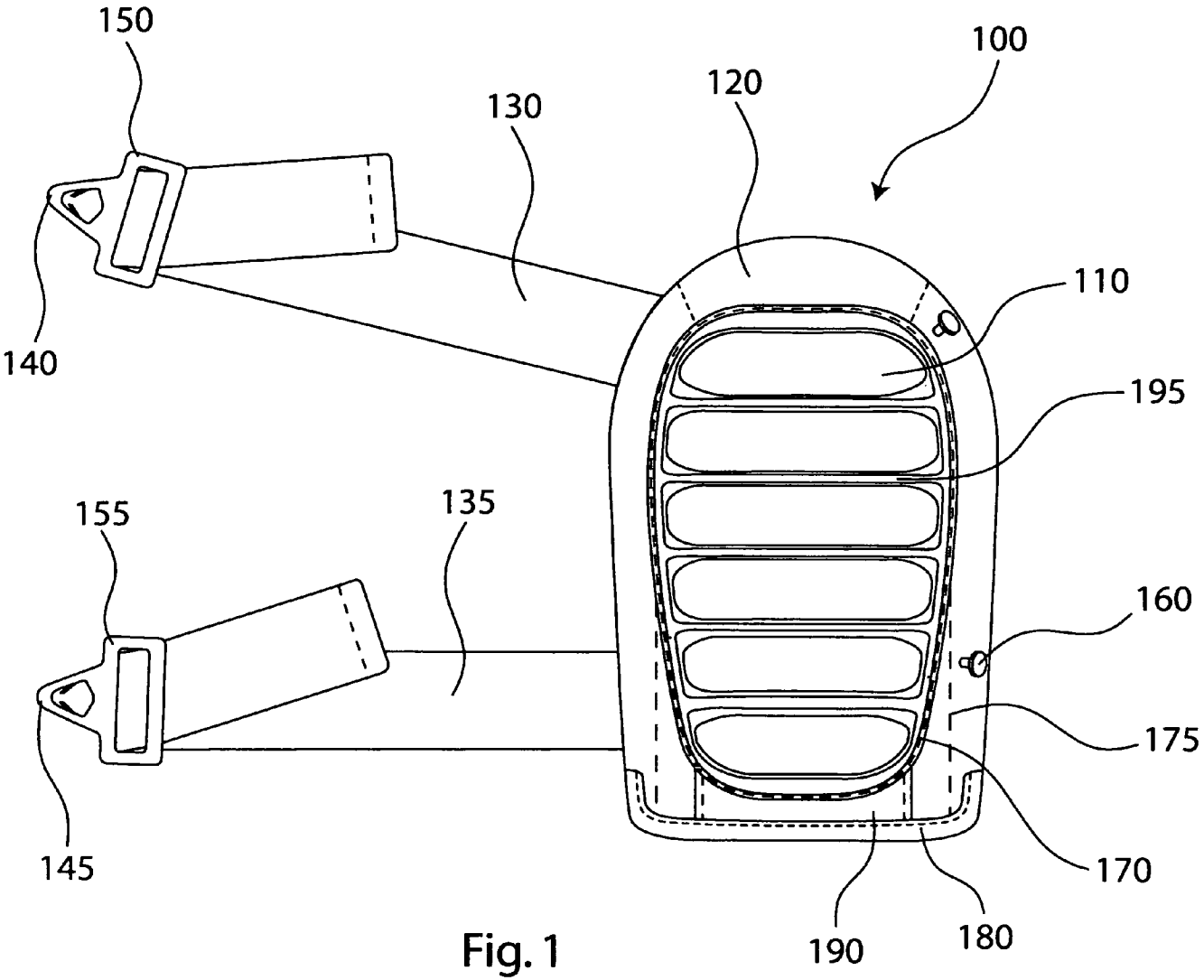
FIG. 1 illustrates a top view of an embodiment of a protective kneepad.
Figure 2:
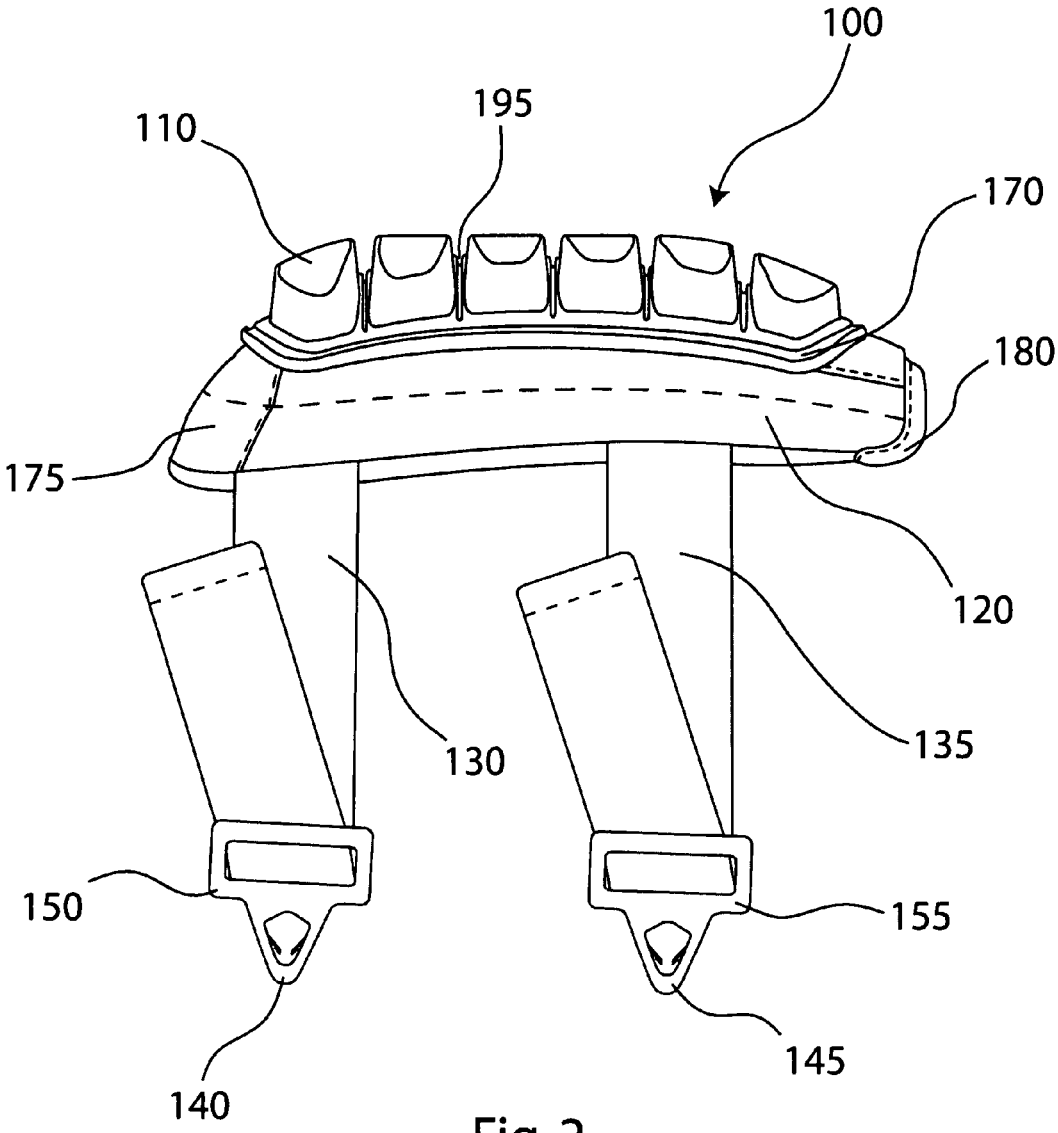
FIG. 2 illustrates a side view of the embodiment illustrated in FIG. 1.

FIG. 1 illustrates a top view of one embodiment of kneepad 100 and FIG. 2 illustrates a side vide of kneepad 100. Kneepad 100 includes multiple layers of protective materials and padding. In one embodiment kneepad 100 includes an outer surface 120, an inner surface 310 (see FIG. 3), an inner padding portion disposed between outer surface 120 and inner surface 310, a protective portion 110 connected to first side 190 of outer surface 120 and means for attaching 130 and 135 kneepad 100 to a wearer's knee.

In one embodiment the means for attaching 130 and 135 include a pair of adjustable straps. Attached to each adjustable strap is a clasp 150, 155 having a connecting portion 140, 145 each having an opening to connect the straps 130,135 to connectors 160. In one embodiment, clasps 150, 155 are made of a heavy duty material, such as hardened molded plastic or similar polymer, a metal or metal alloy, etc. In one embodiment the adjustable straps 130, 135 are made of material that is stretchable to allow expansion and contraction during normal use. In another embodiment, the means for attachment is only one single adjustable strap (not shown). In yet another embodiment, the adjustable strap(s) is made of a stretchable material, such as rubber, combination of nylon (or other similar material) and rubber, etc.

In one embodiment outer surface 120 includes many layers of material, such as first side 190, reinforcement portion 180, and additional layers underneath (not shown) for added protection and sturdiness. In one embodiment, outer surface 120 is made from heavy duty material, such as synthetic leather, canvas, polyester and nylon, etc.

In one embodiment reinforcing stitching 175 is attached to outer surface 120 and is also attached to an internal layer of material. In one embodiment protective portion 110 includes a molded groove where stitching 170 attaches protective portion 110 to outer surface 120.

Figure 3:
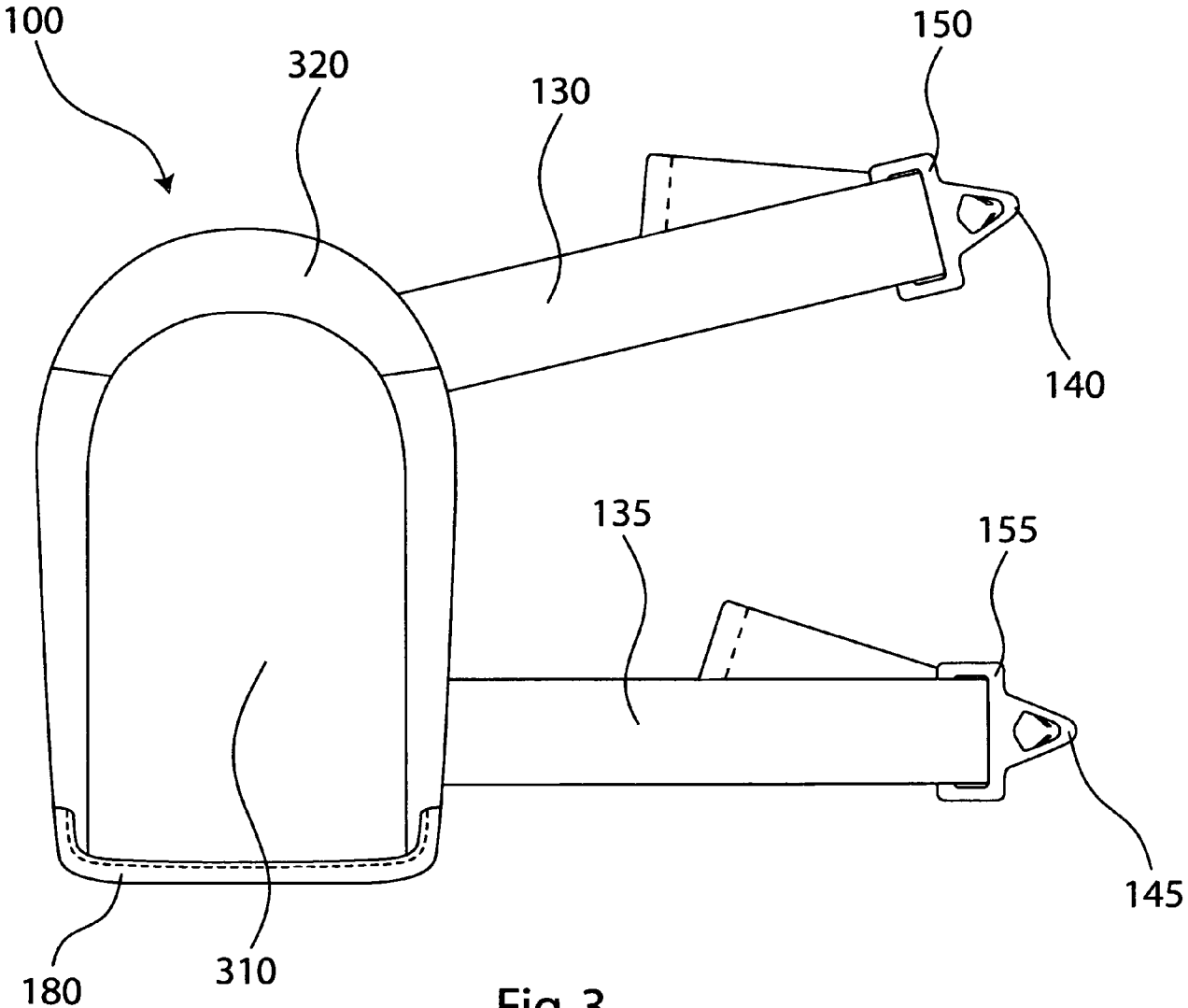
FIG. 3 illustrates a rear view of the embodiment illustrated in FIG. 1.

FIG. 3 illustrates a rear view of kneepad 100. Partially cupped portion 320 when worn by a wearer cups the wearer's kneecap. Inside partially cupped portion 320 is heavy duty resilient padding, such as dense foam material. In another embodiment, partially cupped portion 320 is made of a rigid rubber material. In one embodiment inner portion 310 is covered with a breathable material, such as nylon, nylon mesh, or other synthetic blend materials.

Figure 4:
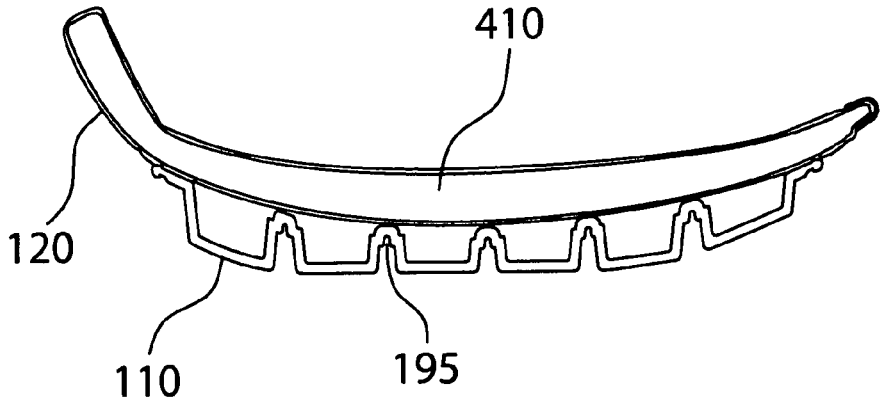
FIG. 4 illustrates a cut-away view of the embodiment illustrated in FIG. 1.

FIG. 4 illustrates a cut-through view of showing protective portion 120 and inner portion of the kneepad. In one embodiment protective portion 110 includes a number of raised elements, such as six (6). In other embodiments, the number of raised elements 110 can be more or less than six, such as four (4), five (5), seven (7), etc. In one embodiment, protective portion 110 is molded in one integral piece. In one embodiment, the raised elements of protective portion 110 are made of resilient material, such as rubber or similar material. In one embodiment the number of raised elements are each spaced apart from each other by a gap 195, which allows protective portion 110 to reactively flex as a wearer bends their knee.

In one embodiment the number of raised elements of protective portion 110 are hollow. In this embodiment the number of raised elements operate to form pneumatic cushioning. A surface 410 of the kneepad (first side 190 and outer surface 120 under protective portion 110 substantially traps air between protective portion 110 and the surface.

Figure 5A:
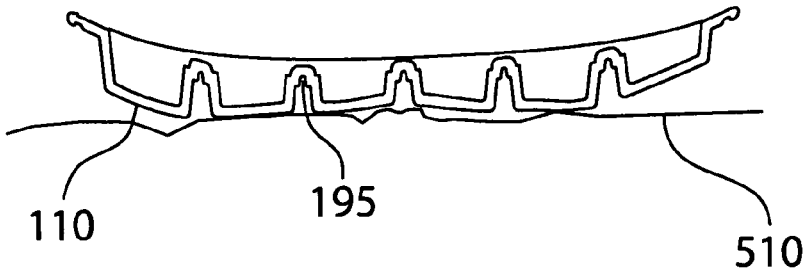
FIG. 5A illustrates a protective cushion portion of the embodiment illustrated in FIG. 1 adapted to the contour of a surface.
Figure 5B:
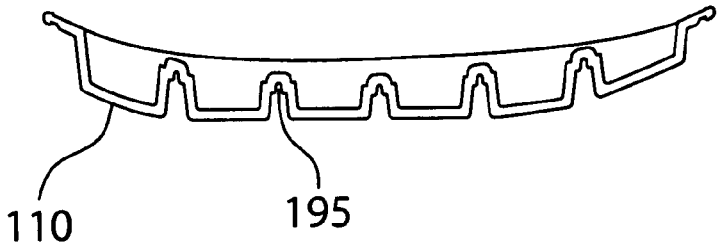
FIG. 5B illustrates a protective cushion portion of the embodiment illustrated in FIG. 1 shown in a relaxed state.
Figure 5C:
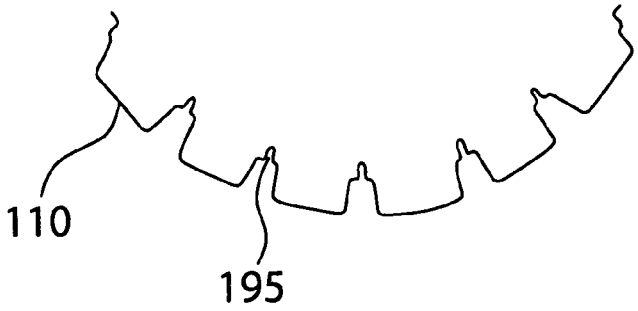
FIG. 5C illustrates a protective cushion portion of the embodiment illustrated in FIG. 1 shown in a bent shape.

FIG. 5A illustrates an isolated view of protective portion 110 having raised elements conform to an uneven surface. As illustrated, each raised element can separately conform to the portion of surface 510 that it is pressed against. This allows a wearer to feel more comfortable and to be spread pressure across the complete kneepad rather than a specific portion. This also allows for more contact with surface 510 to prevent unwanted movement of kneepad 100 (i.e., better traction). FIG. 5B illustrates protective portion 110 in a normal relaxed state. FIG. 5C illustrates protective portion 110 in a flexed state. The flexibility of protective portion 110 allows kneepad 100 to conform to a wearer's knee when standing upright or in a bent position for more comfort and less slippage.

In one embodiment when knee pad 100 is pressed against a surface, such as a floor, roof, etc., the air trapped behind protective portion 110 cannot escape or escapes very slowly. Since the number of raised elements of protective portion 110 are each resilient, the air cushion and protective portion prevent rough surfaces from coming into contact with a wearer's knee.

In the description above, numerous specific details are set forth. However, it is understood that embodiments of the invention may be practiced without these specific details. For example, well-known equivalent components and elements may be substituted in place of those described herein, and similarly, well-known equivalent techniques may be substituted in place of the particular techniques disclosed. In other instances, well-known structures and techniques have not been shown in detail to avoid obscuring the understanding of this description.

Reference in the specification to "an embodiment," "one embodiment," "some embodiments," or "other embodiments" means that a particular feature, structure, or characteristic described in connection with the embodiments is included in at least some embodiments, but not necessarily all embodiments. The various appearances of "an embodiment," "one embodiment," or "some embodiments" are not necessarily all referring to the same embodiments. If the specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other modifications may occur to those ordinarily skilled in the art.

What is claimed is:

1. A kneepad comprising:

an outer surface;

an inner padding portion disposed within the outer surface;

a protective portion coupled to a first side of the outer surface; and means for attaching, wherein the protective portion includes a plurality of externally sealed flexible spaced apart hollow raised elongated elements that passively fill with air trapped between the outer surface and the protective portion for maintaining a gap between an inner portion of each raised element and the outer surface, wherein the gap between the raised elements is expandable.

2. The kneepad of claim 1, wherein the plurality of raised elements are each spaced apart from each other.

3. The kneepad of claim 1, wherein the plurality of raised elements are made of molded stretchable material.

4. The kneepad of claim 3, wherein the plurality of raised elements operate to form pneumatic cushioning.

5. The kneepad of claim 4, wherein a surface of the kneepad under the protective portion substantially traps air between the protective portion and the outer surface for maintaining a protective space between the outer surface and the inner surface of the raised elements upon the protective portion contacting a surface under a force.

6. The kneepad of claim 1, wherein the means for attaching includes a pair of adjustable straps.

7. The kneepad of claim 1, wherein the plurality of raised elements operate to independently conform to an uneven surface.

8. The kneepad of claim 1, wherein the outer surface comprises a plurality of layers.

9. The kneepad of claim 1, wherein the protective portion is attached to the first side with stitching.

10. The kneepad of claim 1, wherein the protective portion is molded in one piece.

11. A kneepad comprising:

a plurality of layered material portions;

at least one inner padding portion coupled between the plurality of layered material portions;

an integral protective covering coupled to an outer surface of the kneepad; and a pair of attachment portions, wherein the integral protective covering includes a plurality of externally sealed flexible spaced apart raised elongated elements that passively form pneumatic cushioning with air trapped between the outer surface, and the integral protective covering maintaining a gap between an inner portion of each raised element and the outer surface, wherein the gap between the raised elements is expandable.

12. The kneepad of claim 11, wherein each of the plurality of raised elements is made of molded stretchable material.

13. The kneepad of claim 11, wherein the integral protective covering includes a hollow chamber and is open on one side.

14. The kneepad of claim 11, wherein a surface of the kneepad under the integral protective covering holds air between the protective portion and the outer surface.

15. The kneepad of claim 11, wherein the plurality of raised elements operate to independently conform to an uneven surface.

16. The kneepad of claim 11, wherein the plurality of raised elements are independently compressible.

17. A kneepad comprising:

a plurality of material portions;

at least one inner padding portion coupled between a first material portion and a second material portion;

an integral protective covering coupled to an outer surface of the kneepad; and a pair of adjustable attachment portions, wherein the integral protective covering includes a plurality of externally sealed flexible spaced apart raised elongated elements, each of the plurality of externally sealed flexible spaced apart raised elongated elements is independently pneumatically compressible, and each of the plurality of externally sealed flexible spaced apart raised elongated elements fills with air that permeates each of the plurality of material portions, where the air is trapped between the outer surface and the integral protective covering maintaining a gap between an inner portion of each of the plurality of externally sealed flexible spaced apart raised elongated elements and the outer surface, wherein the gap between each of the plurality of externally sealed flexible spaced apart raised elongated elements is expandable.

18. The kneepad of claim 17, wherein each of the plurality of externally sealed flexible spaced apart raised elongated elements independently conform to an uneven surface.

19. The kneepad of claim 17, wherein the outer surface of the kneepad holds air between the integral protective covering and the outer surface.

20. The kneepad of claim 17, wherein each of the plurality of externally sealed flexible spaced apart raised elongated elements maintains a protective space between the outer surface and the inner portion of each of the externally sealed flexible spaced apart raised elongated elements upon the integral protective covering contacting a surface under a force.

* * * * *